US008333532B2

(12) United States Patent
Derrigan et al.

(10) Patent No.: US 8,333,532 B2
(45) Date of Patent: Dec. 18, 2012

(54) EXPANSION JOINT SEALING SYSTEM

(75) Inventors: James Derrigan, Tonawanda, NY (US); Dan Wald, Stillwater, MN (US); Monty Guest, Solon, OH (US); Don Starke, Arvada, CO (US)

(73) Assignee: Construction Research & Technology GmbH (DE)

( * ) Notice: Subject to any disclaimer, the term of this patent is extended or adjusted under 35 U.S.C. 154(b) by 0 days.

(21) Appl. No.: 12/836,861

(22) Filed: Jul. 15, 2010

(65) Prior Publication Data

US 2011/0135387 A1 Jun. 9, 2011

Related U.S. Application Data

(60) Provisional application No. 61/225,774, filed on Jul. 15, 2009.

(51) Int. Cl.
*E01C 11/02* (2006.01)

(52) U.S. Cl. ..... 404/69; 404/47; 404/49

(58) Field of Classification Search ..... 404/47, 404/49

See application file for complete search history.

(56) References Cited

U.S. PATENT DOCUMENTS

| | | | | |
|---|---|---|---|---|
| 4,367,976 | A * | 1/1983 | Bowman | 404/68 |
| 4,637,085 | A * | 1/1987 | Hartkorn | 14/73.1 |
| 5,028,168 | A * | 7/1991 | Conversy | 404/68 |
| 5,211,505 | A * | 5/1993 | Ueda | 404/47 |
| 5,269,624 | A * | 12/1993 | Kramer | 404/64 |
| 5,607,253 | A * | 3/1997 | Almstrom | 404/47 |
| 6,997,640 | B1 * | 2/2006 | Hohmann, Jr. | 404/67 |
| 2002/0157338 | A1 * | 10/2002 | Jesko | 52/396.04 |

FOREIGN PATENT DOCUMENTS

| | | |
|---|---|---|
| DE | 100 32 169 Al | 1/2002 |
| EP | 0 512 460 Al | 11/1992 |

OTHER PUBLICATIONS

PCT/US2010/001990—International Search Report, Oct. 4, 2012.
PCT/US2010/001990—Written Opinion of the International Searching Authority, Oct. 4, 2012.

* cited by examiner

*Primary Examiner* — Raymond W Addie
(74) *Attorney, Agent, or Firm* — Curatolo Sidoti Co., LPA; Salvatore A. Sidoti; Julie D. Hawk

(57) ABSTRACT

An expansion joint sealing system may be used to provide a continuous and seamless waterproof membrane across a gap in an expansion joint. The expansion joint sealing system includes sealing members that are provided with a keyway for accepting and interlocking a coating membrane. Also disclosed are an expansion joint including spaced apart structural members and the sealing system and a method for sealing a gap between two spaced apart structural members.

23 Claims, 4 Drawing Sheets

EXPANSION JOINT SEALING SYSTEM

CROSS REFERENCE TO RELATED APPLICATIONS

This application claims the benefit of the filing date under 35 U.S.C. §119(e) of U.S. Provisional Application For Patent Ser. No. 61/225,774 filed on Jul. 15, 2009, which incorporated herein by reference.

TECHNICAL FIELD

Disclosed is an expansion joint seal system for sealing a gap between spaced-apart building structures. The expansion joint seal may be used to seal a gap located between spaced-apart structural members in roads, bridge decks, parking decks, plaza deck, and the like.

BACKGROUND

An expansion joint gap is intentionally provided between spaced-apart building structures to accommodate dimensional changes in response to expansion and contraction. The expansion joint may be damaged by the ingress of water and debris, by abrasion, or forces generated by the passage of pedestrian or vehicular traffic across the gap. Elongated expansion joint seals are placed in the gap between the spaced-apart building structures in an end-to-end relationship in an attempt to protect the expansion joint from damage.

Liquid applied coating membranes are used in combination with elastomeric expansion joint seals in an attempt to provide a waterproof seal across a gap in an expansion joint. Oftentimes, however, the coating membrane does not form a positive seal with the elastomeric sealing member and water and debris are able to penetrate the sealing system.

SUMMARY

Disclosed is an expansion joint sealing system comprising a seal member having a recess for accepting a liquid coating; and a cured coating interlocked with said recess of said seal member.

Additionally disclosed is an expansion joint comprising two spaced-apart structural members defining a gap between said structural members; at least one seal member affixed to at least one of said structural members, said seal member having a recess for accepting a liquid coating; and an a cured coating interlocked with said recess of said seal member.

According to certain illustrative embodiments, the sealing member comprises base members that are engaged with said structural members and at least one further sealing member engaged with said base members and bridging the gap between said structural members.

Further disclosed is a method of sealing an expansion joint gap between two structural members comprising affixing base at least one sealing member to said structural members, said sealing member comprising a recess for accepting a coating membrane; applying a liquid coating to said sealing member such that the liquid coating enters the recess; and curing the said coating.

DETAILED DESCRIPTION

Figure 1:
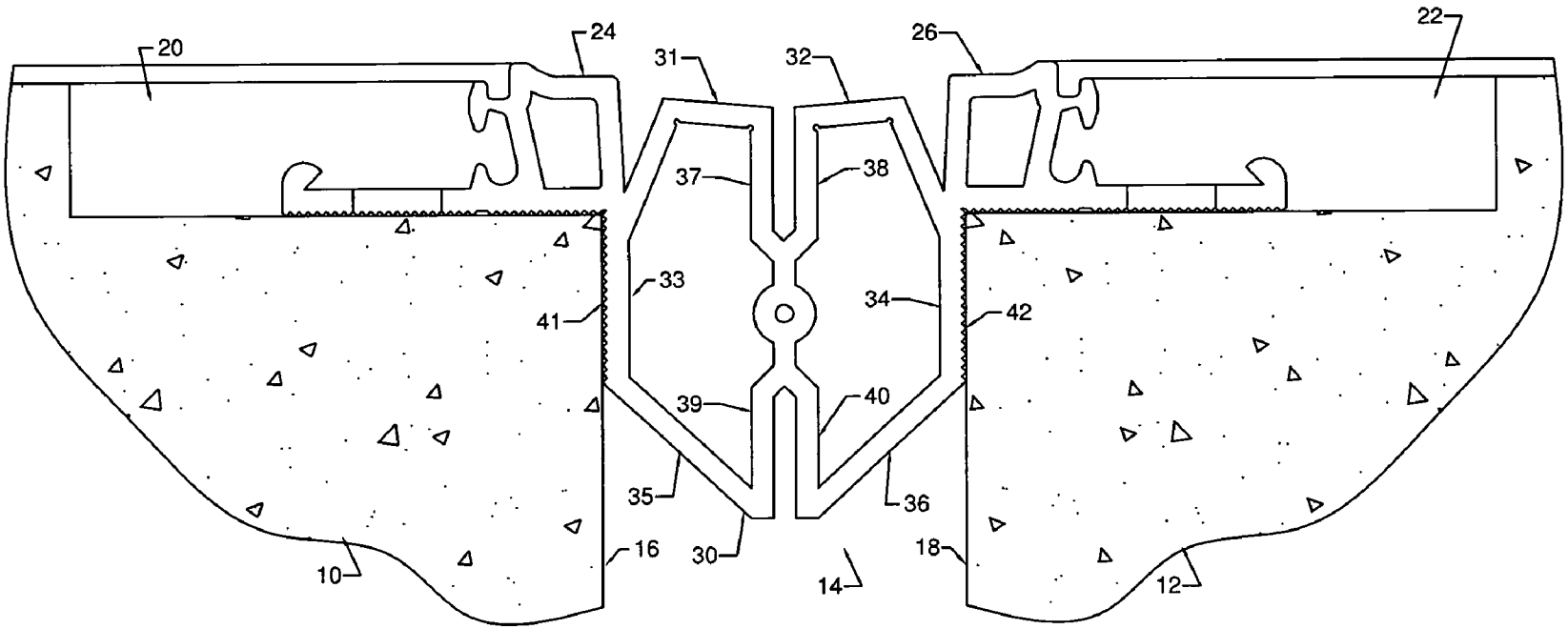
FIG. 1 is a cross-section view of an illustrative embodiment of the expansion joint system.

Disclosed is an expansion joint sealing system and an expansion joint incorporating the expansion joint sealing system. The expansion joint sealing system comprises at least one elongated sealing member and a coating that is applied to the sealing member. The expansion joint sealing member may be provided with a keyway, such as groove or recess, that is formed in a portion of its thickness to accept a liquid applied coating. Once the liquid applied coating cures, the coating becomes interlocked with the expansion joint sealing element via the cured coating in the keyway of the sealing element. Curing and interlocking the liquid applied coating provides a waterproof expansion joint sealing system for the expansion joint gap.

Any known rubber or foam expansion joint sealing element, member, or profile may be utilized as the expansion joint sealing element. There is no limitation as to the material from which the expansion joint sealing element is made or the shape of expansion joint sealing element. Without limitation, suitable expansion joint seals include elastomeric glandular seals, elastomeric compression seals, elastomeric strip seals, closed cell polymeric foam seals, such as neoprene foam seals and polyurethane foam seals. The term "elastomeric" refers for a material that possesses rubber-like properties, for example, an elastomeric material will substantially recover its original dimensions after compression and/or elongation. The expansion joint seal member may be manufactured from a thermoplastic elastomer. Suitable thermoplastic elastomers include, without limitation, butadiene rubber, styrene-butadiene rubber, butyl rubber, ethylene-propylene rubber, ethylene-propylene-diene rubber, polyisoprene rubber, polychloroprene rubber, silicon rubber, neoprene, nitrile rubber and blends thereof. A particularly suitable thermoplastic elastomer composition that is useful to prepare the expansion joint seal is commercially available from Advanced Elastomer Systems, L.P. (Akron, Ohio) under the trade name Santoprene™.

The liquid applied coating may be any manufactured from any waterproof material that can form a continuous coating or membrane. By way of illustration, the liquid applied coating material may comprise a polymeric coating or membrane material. According to certain illustrative embodiments, the polymeric coating material comprises an elastomeric material. Suitable coatings include urethane based, epoxy based, polyurea based, and methylmethacrylate based coatings or membranes. Without limitation, such coating or membrane-forming materials are commercially available from BASF Corporation—Building Systems (Shakopee, Minn., USA).

The expansion joint sealing element or elements are affixed to the underlying spaced-apart building structures, such as underlying concrete or steel structures, to bridge the gap located between the two structures. The expansion joint sealing element may be affixed to the underlying structural member by any means known in the art, such as by an adhesive or by mechanical fasteners. According to certain illustrative embodiments, the expansion joint sealing elements are adhesively affixed to the underlying concrete or steel building structures. Without limitation a suitable adhesive material that may be used to adhere the expansion joint sealing elements to the underlying building structure is commercially available from Watson Bowman Acme Corporation (Amherst, N.Y., USA) under the designation WABO GEL ADHESIVE. The WABO GEL ADHESIVE product is a rapid curing, epoxy gel adhesive. This particular adhesive material is suitable for bonding a wide variety of foam and rubber expansion joint sealing elements to either concrete or steel substrates. The high viscosity of the gel adhesive makes it suitable for both horizontal and vertical applications. In order to adhesively affix the expansion joint sealing element to the underlying building substrate, the gel adhesive may be applied to the sealing element, to the surface of the underlying concrete or steel substrate to which the sealing element is to be adhered, or to both the sealing element and to surfaces of the underlying concrete or steel substrate.

Recesses are often cut into marginal areas of the underlying concrete building structure adjacent the gap to accommodate the expansion joint sealing system. These recesses are commonly referred to in the art as "block-out" areas or regions. The block-out areas are filled with a suitable filling material to provide a smooth transition across the expansion joint gap. Without limitation, a suitable filling material comprises an elastomeric concrete that is commercially available from Watson Bowman Acme Corporation (Amherst, N.Y., USA) under the trade designation WABOCRETE II. WABOCRETE II elastomeric concrete is a self-leveling 100% solids material comprising a two-component polyurethane and aggregate. Another suitable filler material comprises a polymer modified expansion joint header material that is commercially available from Watson Bowman Acme Corporation under the trade designation WABO POLYEDGE. WABO POLYEDGE comprises a blend of epoxy resin and aggregate to form a moisture insensitive filler material that adheres to underlying concrete and metal surfaces.

After the expansion joint sealing element or plurality of elements have been affixed to the underlying concrete or steel building structures and the recessed "block-out" area have been filled with a suitable filler material, the liquid coating is applied. The coating comprises a liquid that cures to form a monolithic or otherwise seamless water-proof coating membrane. The liquid applied coating may be any manufactured from any waterproof material that can form a continuous coating or membrane. By way of illustration, the liquid applied coating material may comprises a polymeric material. According to certain illustrative embodiments, the polymeric coating material comprises an elastomeric material.

According to certain embodiments, the liquid coating is applied by spreading the liquid coating over the upper surface of the block-out filler material and into the keyway formed in the expansion joint sealing element. According to other embodiments, the liquid coating is applied to the traffic bearing surface of the concrete building structure, across the block-out filler material and into the keyway formed in the expansion joint sealing elements.

Any waterproof coating material may be used in combination with the expansion joint sealing element having a keyway formed therein to create a continuous waterproof membrane across an expansion joint gap located between two spaced-apart structural members. The waterproof coating may comprise a polymeric coating or an aggregate filler polymeric coating. An aggregate filled polymeric coating would be appropriate for applications that require a more skid resistant coating membrane. Without limitation, a suitable waterproof coating for concrete is commercially available from BASF Corporation—Building Systems (Shakopee, Minn., USA) under the designation TRAFFICGUARD EP35. This coating system comprises a rapid-curing, skid-resistant, aggregate-filled epoxy coating. This coating may be applied to an underlying concrete building substrate with or without a primer layer. The coating cures to a waterproof membrane overlay that prevents the ingress of water into the expansion joint. Because the coating has a low modulus, it is able to accommodate thermal movements in the underlying building substrate. The TRAFFICGUARD EP35 coating is especially suitable for use with expansion joint sealing systems for parking and bridge decks.

Another suitable liquid-applied coating for use in combination with the expansion joint sealing element is also commercially available BASF Corporation—Building Systems (Shakopee, Minn., USA) under the designation CONIPUR II DECK COATING SYSTEM. The coating system comprises primer (CONIPUR 78, two-component polyurethane adhesive primer), a base coat (CONIPUR 265-Z, a fast-curing polyurethane layer), and a top coat (CONIPUR 275 aromatic urethane coating layer or CONIPUR 295 aliphatic coating membrane). CONIPUR II deck coating system cures to provide a seamless waterproof membrane for concrete substrates. The seamless waterproof membrane prevents ingress of water and debris, thereby protecting the expansion joint from water damage, freeze/thaw damage, chloride intrusion, and typical parking deck chemicals, such as gasoline, diesel fuel, oil, alcohol, ethylene glycol, de-icing salts, bleach and other cleaning chemicals.

Illustrative embodiments of the expansion joint incorporating the expansion joint seal will be described in further detail with reference to the drawing FIGURES. It should be noted that the embodiments show in the drawing FIGURES are intended to be merely illustrative and should not be considered to limit the expansion joint system in any manner.

Referring to FIG. 1, an illustrative embodiment of the expansion joint seal is shown. Structural members 10 and 12 are positioned to form a gap 14 between terminal end surfaces 16 and 18 of the structural members 10 and 12, respectively. The structural members 10, 12 may take the form of precast slabs used to form passageways for both vehicle and pedestrian traffic. The structural members 10, 12 are supported by underlying superstructure (not shown). Marginal edge cavities 20, 22 are formed in the upper surfaces of building structures 10, 12. The marginal edge cavities 20, 22 are collectively known in the relevant art as a "block-out" area.

Still referring to FIG. 1, base members 24, 26 are affixed to surfaces of building structures 10, 12. The base members 24, 26 may be affixed to building structures 10, 12 by any suitable means, for example, by means of a suitable adhesive that will form a bond between the base members 10, 12 and the surfaces of the underlying building structures 10, 12. Without limitation, and only by way of illustration, a suitable adhesive to adhesively bond the base members 24, 26 to building structures 10, 12 comprises an epoxy adhesive. As shown in FIG. 1, base members 24, 26 may comprise inverted L-shaped profiles. It should be noted, however, that the base members 24, 26 may be provided in any shape or profile so long as the base members are capable of being affixed to the underlying building structures and with a suitable expansion joint seal. The marginal edge cavities 20, 22 are filled with a suitable material to further affix the base members 24, 26 to the building structures 10, 12 and to provide an even transition across the expansion joint gap 14. A suitable filling material comprises an elastomeric concrete that is commercially available from Watson Bowman Acme Corporation (Amherst, N.Y., USA) under the trade designation WABOCRETE II. The WABOCRETE II elastomeric concrete is a self-leveling 100% solids material comprising a two-component polyurethane and aggregate. Another suitable filler material comprises a polymer modified expansion joint header material that is commercially available from Watson Bowman Acme Corporation under the trade designation WABO POLYEDGE. WABO POLYEDGE comprises a blend of epoxy resin and aggregate to form a moisture insensitive filler material that adheres to underlying concrete and metal surfaces.

As shown in FIG. 1, expansion joint sealing profile member 30 is positioned within gap 14 between building structures 10, 12. Expansion joint seal profile 30 comprises a compressible seal comprises a number of walls forming the seal. Expansion joint seal comprises top walls 31, 32, outside side walls 33, 34 and downward sloping bottom walls 35, 36. Expansion joint seal profile 30 also includes inside side walls 37, 38 extending downwardly from top walls 31, 32, respectively. Inside side wall 39, 40 extend upwardly from bottom walls 35, 36, respectively. Inside side walls 37-40 converge substantially near the center of the seal profile 30. At least a portion of the outside side walls 33, 34 of profile 30 include teeth 41, 42 that project outwardly from the outside side walls 33, 34 of profile 30.

Figure 2:
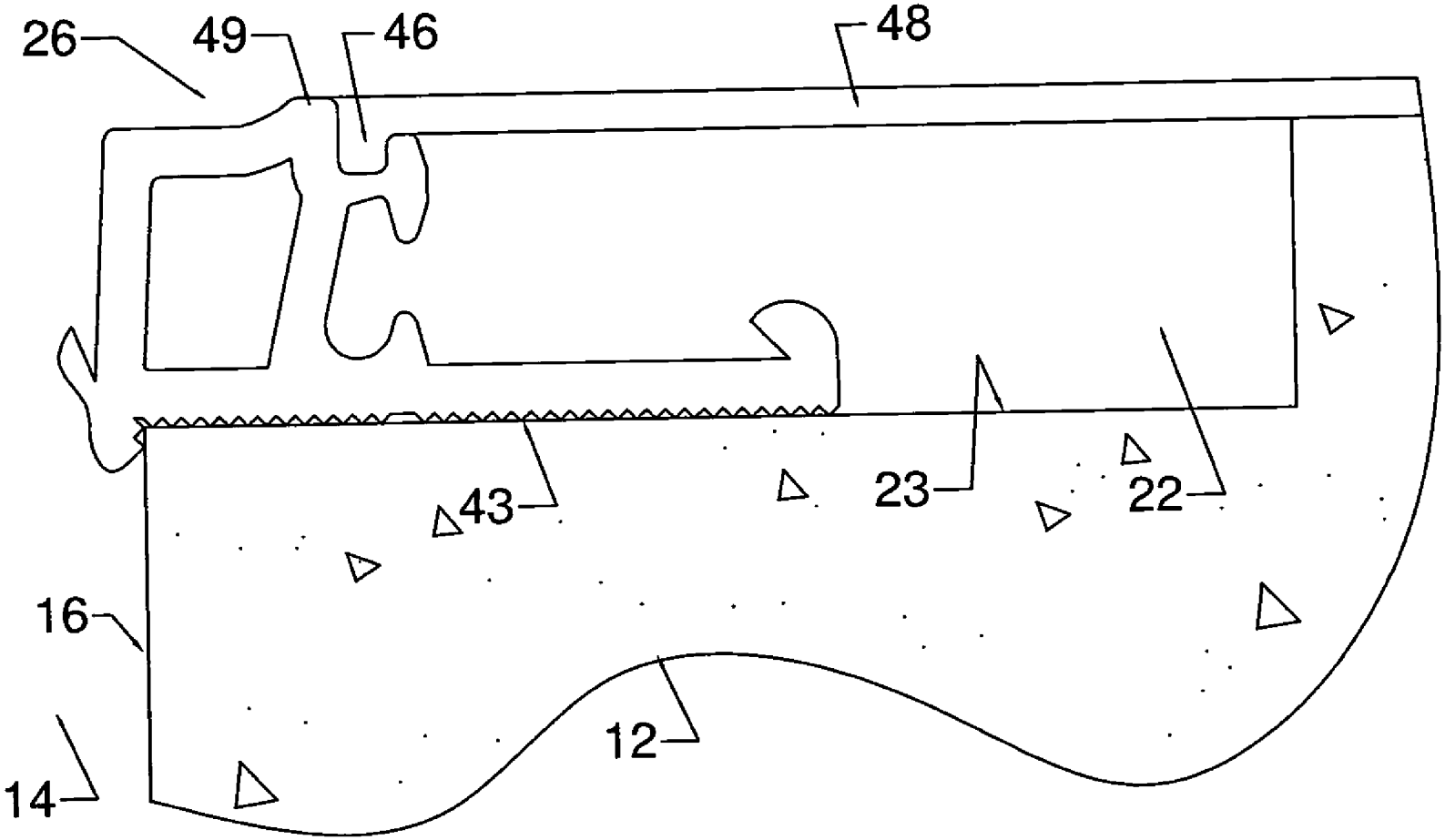
FIG. 2 is an enlarged fragmentary side view of a portion of the illustrative embodiment of the expansion joint system of FIG. 1.

Turning to FIG. 2, base portion 26 is shown affixed to building member 12. Base portion 26 is substantially L-shaped and one surface of the L-shaped member includes teeth for engaging the side wall 16 of building member 12 and for engaging a sealing member that bridges the gap 14 between the two structural members 10, 12. Another portion of the L-shaped base member 26 includes teeth 43 for engaging with the upper surface 23 of block-out region 22. Base member 26 includes a keyway 46 for accepting liquid applied coating materials. Water-proof coating material 48 is shown as applied to the upper traffic surfaces of structural member 12, upper surface of the block-out filler material disposed in block-out region 22 and is interlocked with the base sealing member 26 via keyway 46. Based member 26 also includes raised edge portion 49 extending upwardly from base member at a point that is substantially near one later edge of keyway 46.

Figure 3:
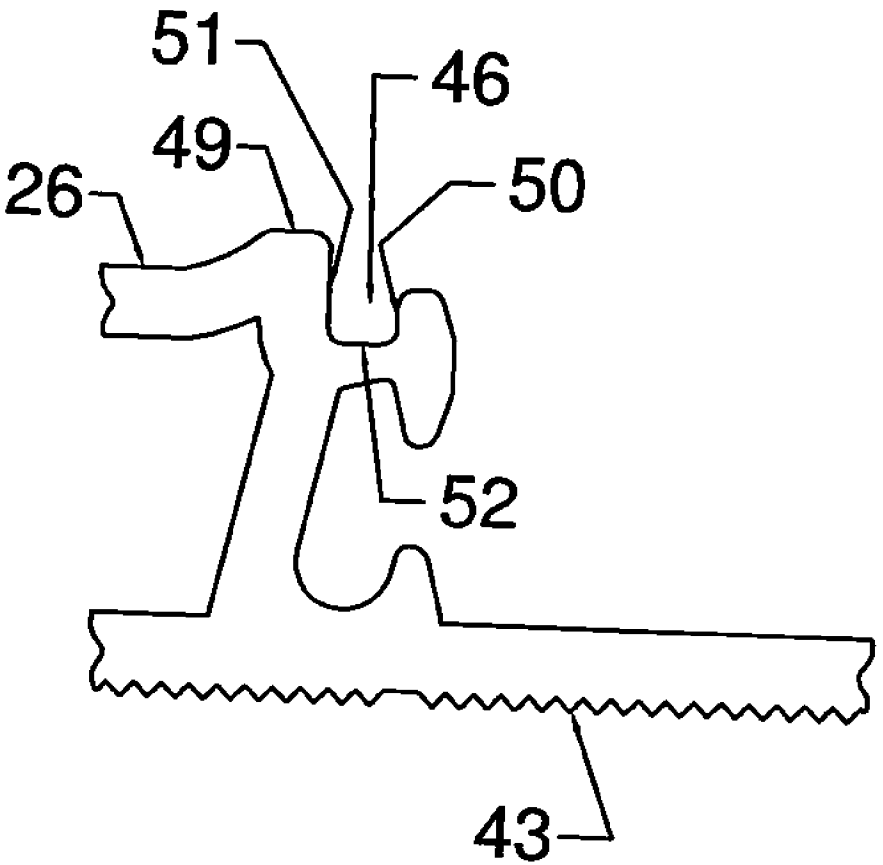
FIG. 3. is a cross-section showing the recess in a seal member for accepting a waterproofing coating.

Now turning to FIG. 3, a detailed view of the recess 46 of base portion 26 of the expansion joint seal is shown. Recess 46 is defined by front wall 50, rear wall 51 and bottom wall 52. Recess 46 includes an open top to allow for the introduction of a fluid- or liquid-applied waterproofing coating material. Rear wall 51 of recess 46 extends upwardly beyond the height of the front wall 50 to form a drip edge 49 to prevent passage of the fluid-applied coating material.

Figure 4:
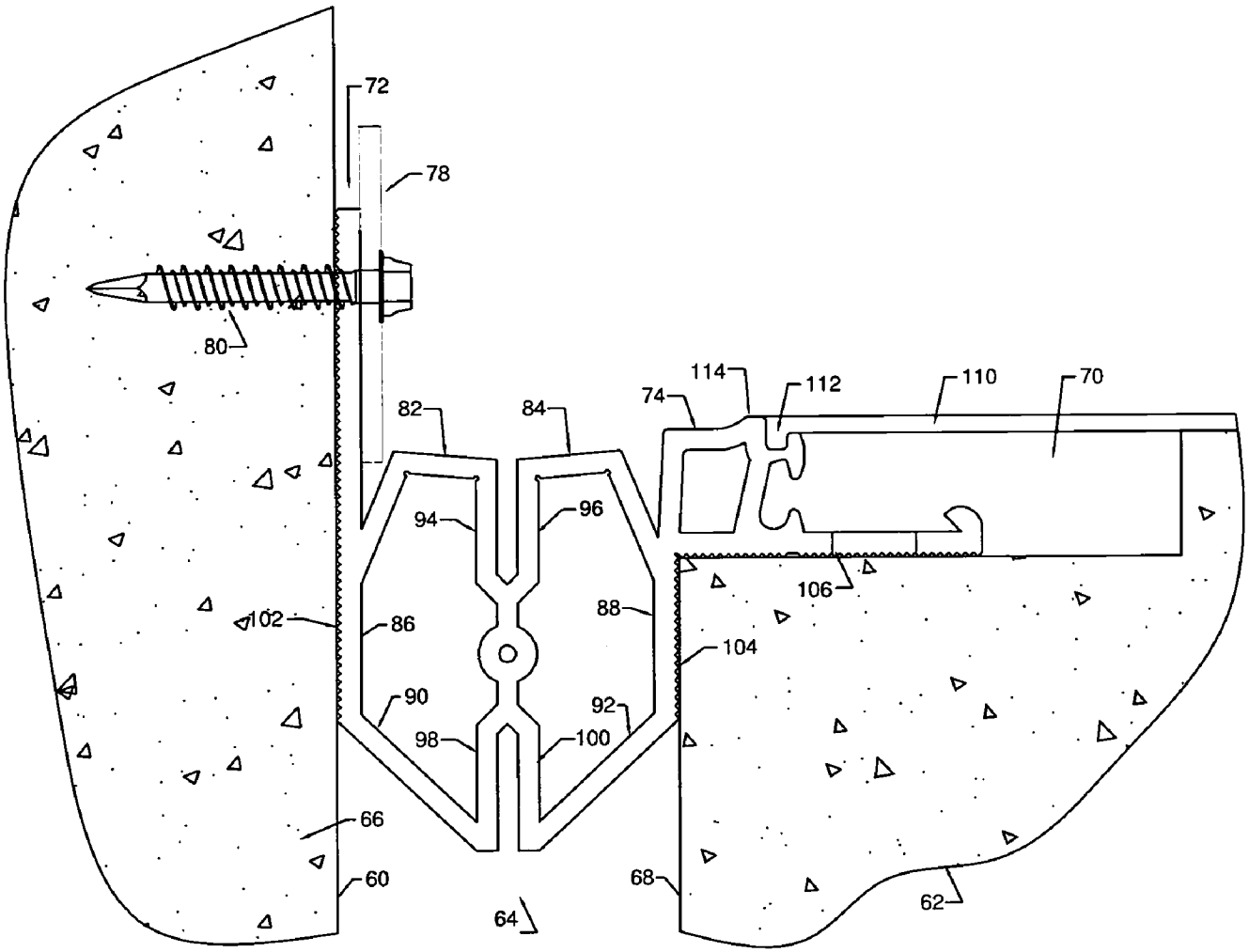
FIG. 4 is a cross-section view of yet a further illustrative embodiment of the expansion joint system.

Referring to FIG. 4, an illustrative embodiment of the expansion joint seal is shown. Vertical wall structural member 60 and horizontal structural member 62 are positioned to form a gap 64 between terminal end surfaces 66 and 68 of the structural members 60 and 62, respectively. Marginal edge cavity 70 is formed in the upper surface of building structure 62. The marginal edge cavity 70 is known in the relevant art as a "block-out" area.

Still referring to FIG. 4, base portions 72, 74 of the seal are affixed to surfaces of building structures 60, 62. The base portions 72, 74 may be affixed to building structures 60, 62 by any suitable means, for example, by means of a suitable adhesive that will form a bond between the base portions 72, 74 and the surfaces of the underlying building structures 60, 62. Without limitation, base portion 72 is affixed to vertical building structure 60 by means of a plate 78 and mechanical fastener 80. Without limitation, and only by way of illustration, a suitable adhesive may be used to adhesively bond the base portion 74 to building structure 62 comprises an epoxy adhesive. As shown in FIG. 4, base portion 74 comprises a substantially L-shaped profile. The marginal edge cavity 70 is filled with a suitable material, such as WABOCRETE II.

As shown in FIG. 4, expansion joint sealing profile member is positioned within gap 64 between building structures 60, 62. Expansion joint seal profile comprises a compressible seal comprises a number of walls forming the seal. Expansion joint seal comprises top walls 82, 84, outside side walls 86, 88 and downward sloping bottom walls 90, 92. Expansion joint seal profile also includes inside side walls 94, 96 extending downwardly from top walls 82, 84, respectively. Inside side wall 98, 100 extend upwardly from bottom walls 90, 92 respectively. Inside side walls 94, 96, 98, 100 converge substantially near the center of the seal profile. At least a portion of the outside side walls 86, 88 of profile include teeth 102, 104 that project outwardly from the outside side walls 86, 88 the sealing member. L-shaped base portion is provided with teeth 106 that project downwardly from the sealing member to engage a surface of the block-out region 70.

Water proof coating 110 is engaged with base portion 74 via keyway 112. Raised drip edge 114 prevents the inadvertent introduction of the liquid coating material into expansion joint gap 64.

The method of sealing an expansion joint gap that is positioned between two spaced-apart structural members includes attaching the elastomeric sealing member to the spaced-apart structural members. The sealing member may be attached to the spaced-apart structural members by any suitable means, such as adhesives and/or mechanical fasteners. Suitable mechanical fasteners may include nails, tacks, rivits, rods, pegs, screws and the like. If the spaced-apart structural members are provided with the marginal edge cavities, then these cavities are filled with a suitable material, such as the WABOCRETE elastomeric concrete. The coating membrane is liquid applied in a manner such that it spans the upper surface of the structural member, the upper surface of the filler material, if present, and engages and become interlocked with a portion of the elastomeric sealing member. This provides a continuous waterproof coating membrane that prevents the ingress of water and debris.

According to certain illustrative embodiments, the sealing member may be provided with a raised portion that creates a drip edge along an edge of the sealing member. The drip edge provides a means by which to terminate the liquid applied coating and prevents the coating materials from entering the expansion joint gap.

While the expansion joint seal and expansion joint system, and associated methods for making the expansion joint seal and method of sealing an expansion joint, have been described in connection with the preferred embodiments, as shown in the various figures, it is to be understood that other similar embodiments may be used or modifications and additions may be made to the described embodiment for performing the same function of the present invention without deviating therefrom. Therefore, the expansion joint seal should not be limited to any single embodiment, but rather construed in breadth and scope in accordance with the recitation of the appended claims.

The invention claimed is:

1. An expansion joint sealing system comprising:

at least one sealing member traversing an expansion gap between two structural members and having a recess in its thickness for accepting a liquid coating;

a block-out area formed adjacent to the gap in at least one of said structural members, wherein a portion of said sealing member is positioned within said block-out area;

a filler material arranged within said block-out area; and a cured coating disposed on an upper surface of said filler material and at least a portion of at least one of said structural members and interlocked with said recess of said sealing member.

2. The expansion joint sealing system of claim 1, wherein said recess comprises a continuous recess extending along substantially the entire length of said sealing member.

3. The expansion joint sealing system of claim 1, wherein said recess comprises a plurality of discontinuous recesses extending along substantially the entire length of said sealing member.

4. The expansion joint sealing system of claim 1, wherein said sealing member comprises a raised edge extending upwardly from a lateral edge of said recess.

5. The expansion joint sealing system of claim 1, wherein said sealing member comprises a thermoplastic elastomer.

6. The expansion joint sealing system of claim 5, wherein said thermoplastic elastomer is selected from the group consisting of butadiene rubber, styrene-butadiene rubber, butyl rubber, ethylene-propylene rubber, ethylene-propylene-diene rubber, polyisoprene rubber, polychloroprene rubber, silicon rubber, neoprene, nitrile rubber and blends thereof.

7. The expansion joint sealing system of claim 6, wherein said elastomeric material comprises ethylene-propylene-diene rubber.

8. The expansion joint sealing system of claim 1, wherein said coating comprises an elastomeric polymer.

9. The expansion joint sealing system of claim 8, wherein said coating comprises an aggregate filled elastomeric coating.

10. The expansion joint of claim 8, wherein said elastomeric polymer comprises an epoxy or a urethane polymer.

11. An expansion joint comprising:

two spaced-apart structural members defining a gap between said members;

block-out areas defined within said structural members adjacent to the gap;

at least one sealing member having a recess in its thickness for accepting a liquid coating, wherein at least a portion of said sealing member is positioned within said block-out areas;

a filler material arranged within said block-out areas; and a cured coating disposed on an upper surface of said filler material and at least a portion of at least one of said structural members and interlocked with said recess of said sealing member.

12. The expansion joint of claim 11, wherein said sealing member comprises a single piece that is affixed to the structural members and bridges the gap between the structural members.

13. The expansion joint of claim 11, wherein said sealing member comprises base members affixed to said structural members and at least one further sealing member engaged with said base members and extending between said based members to bridge the gap between said structural members.

14. The expansion joint of claim 11, wherein said recess comprises a continuous recess extending along substantially the entire length of said sealing member.

15. The expansion joint of claim 11, wherein said recess comprises a plurality of discontinuous recesses extending along substantially the entire length of said sealing member.

16. The expansion joint of claim 11, wherein said sealing member comprises a raised edge extending upwardly from a lateral edge of said recess.

17. The expansion joint of claim 11, wherein said sealing member comprises a thermoplastic elastomer.

18. The expansion joint of claim 17, wherein said thermoplastic elastomer is selected from the group consisting of butadiene rubber, styrene-butadiene rubber, butyl rubber, ethylene-propylene rubber, ethylene-propylene-diene rubber, polyisoprene rubber, polychloroprene rubber, silicon rubber, neoprene, nitrile rubber and blends thereof.

19. The expansion joint sealing claim 18, wherein said elastomeric material comprises ethylene-propylene-diene rubber.

20. The expansion joint of claim 11, wherein said coating comprises an elastomeric polymer.

21. The expansion joint of claim 11, wherein said coating comprises an aggregate filled elastomeric coating.

22. The expansion joint of claim 20, wherein said elastomeric polymer comprises an epoxy or a urethane polymer.

23. A method of sealing an expansion joint gap between two structural members comprising:

affixing at least one sealing member to at least one block-out area defined within said structural members adjacent to the gap so as to traverse said expansion joint, said sealing member comprising a recess for accepting a coating;

filling said block-out areas with a filler material;

applying a liquid coating to an upper surface of said filler material and at least a portion of at least one of said structural members, said sealing member such that the liquid coating enters the recess; and curing the said coating.

* * * * *